US010569318B2

(12) United States Patent
Takahashi et al.

(10) Patent No.: US 10,569,318 B2
(45) Date of Patent: Feb. 25, 2020

(54) CUTTING APPARATUS AND CUTTING BLADE

(71) Applicant: NITTAN VALVE CO., LTD., Kanagawa (JP)

(72) Inventors: Masaharu Takahashi, Kanagawa (JP); Kazuhiro Ohyou, Kanagawa (JP)

(73) Assignee: NITTAN VALVE CO., LTD., Kanagawa (JP)

( * ) Notice: Subject to any disclaimer, the term of this patent is extended or adjusted under 35 U.S.C. 154(b) by 0 days.

(21) Appl. No.: 15/540,930

(22) PCT Filed: Feb. 15, 2016

(86) PCT No.: PCT/JP2016/054252
§ 371 (c)(1),
(2) Date: Jun. 29, 2017

(87) PCT Pub. No.: WO2017/141305
PCT Pub. Date: Aug. 24, 2017

(65) Prior Publication Data

US 2018/0104730 A1 Apr. 19, 2018

(51) Int. Cl.
*B21C 35/02* (2006.01)
*B26D 1/09* (2006.01)
(Continued)

(52) U.S. Cl.
CPC ..... *B21C 35/02* (2013.01); *B26D 1/085* (2013.01); *B26D 1/09* (2013.01); *B26D 3/00* (2013.01);
(Continued)

(58) Field of Classification Search
CPC ..... B26D 2001/002; B26D 2001/0066; B26D 1/08; B26D 1/085; B26D 1/09;
(Continued)

(56) References Cited

U.S. PATENT DOCUMENTS 1,414,997 A * 5/1922 Zinn ..... A22B 3/10 30/165
5,297,746 A * 3/1994 McBride ..... B02C 18/148 241/242

(Continued)

FOREIGN PATENT DOCUMENTS

| | | | |
|---|---|---|---|
| JP | 04-232318 A | | 8/1992 |
| JP | 2002-292164 A | | 10/2002 |
| JP | 2004-306204 A | | 11/2004 |
| JP | 2013-180536 A | | 9/2013 |
| JP | 2013180536 A | * | 9/2013 |

OTHER PUBLICATIONS

Written Opinion of the International Searching Authority issued in the corresponding Application No. PCT/JP2016/054252 dated May 17, 2016.

*Primary Examiner* — Evan H MacFarlane
(74) *Attorney, Agent, or Firm* — Roberts Mlotkowski Safran Cole & Calderon P.C.

(57) ABSTRACT

A cutting apparatus and a cutting blade is capable of restraining a highly-viscous substance from bending while preventing damage to a blade edge part. A pair of the cutting blades are configured for an approaching/separating movement, and the cutting blades are arranged with blade edge parts facing each other while having thickness directions oriented in the same direction. The cutting blades each have a gradually increasing thickness increased from a blade edge leading end toward a blade root part and have blade edge parts that are offset from one another in the thickness direction of the cutting blades. Each of the cutting blades has a surface in the thickness direction made of a material having a hardness lower than the blade edge part of the other cutting blade.

4 Claims, 6 Drawing Sheets

(51) Int. Cl.
*B26D 3/00* (2006.01)
*B26D 1/08* (2006.01)
*B26D 1/00* (2006.01)

(52) U.S. Cl.
CPC ..... *B26D 2001/002* (2013.01); *B26D 2001/0066* (2013.01)

(58) Field of Classification Search
CPC . B26D 1/095; B26D 3/00; B26D 3/16; B26D 1/00; B26D 1/26; B26D 1/265; B29B 9/06; B29B 9/14; B21C 35/02; B21C 35/04; Y10S 83/932; Y10T 83/9447
USPC ..... 83/694, 932, 950; 425/132; 30/90.1, 30/138, 182, 194, 208–225
See application file for complete search history.

(56) References Cited

U.S. PATENT DOCUMENTS 6,105,261 A * 8/2000 Ecer ..... B26B 9/00 30/346.54
6,688,207 B2 * 2/2004 Tabeling ..... G02B 6/25 225/103
2007/0089471 A1 * 4/2007 Otaki ..... B21C 23/08 72/256
2010/0126319 A1 * 5/2010 Mader ..... B26D 1/0006 83/13
2011/0030526 A1 * 2/2011 Miyazaki ..... B23K 1/0008 83/651
2012/0124844 A1 * 5/2012 Droese ..... B26B 9/00 30/314

* cited by examiner

CUTTING APPARATUS AND CUTTING BLADE

CROSS-REFERENCE TO RELATED APPLICATIONS

The present application is a U.S. National Phase of PCT/JP2016/054252 filed on Feb. 15, 2016. The disclosure of the PCT Application is hereby incorporated by reference into the present Application.

TECHNICAL FIELD

The present invention relates to a cutting apparatus and a cutting blade used in the cutting apparatus.

BACKGROUND ART

In various industrial fields, an extruder extruding a highly-viscous substance (clay-like substance) is used. Generally, as described in Patent Document 1, the extruder is loaded with a highly-viscous substance in an extruder main body and extrudes the highly-viscous substance in the extruder main body with a pressing tool from a nozzle of the extruder main body into a rod shape and the extruded elongated-shaped highly-viscous substance is cut by a cutting blade at a predetermined length from a leading end. In this case, if the elongated-shaped highly-viscous substance is sheared by one cutting blade, the elongated-shaped highly-viscous substance may bend in the shearing direction at the time of shearing and may no longer be accommodated in an incorporating object, and it is therefore proposed to eject liquid nitrogen toward the extruded elongated-shaped highly-viscous substance before cutting by the one cutting blade to cool and harden the rod-like highly-viscous material so that the cooled and hardened elongated-shaped high substance is cut by using the one cutting blade (see Patent Document 1).

However, if the elongated-shaped highly-viscous substance is cooled and hardened by using liquid nitrogen as described above, a complicated ejecting mechanism is required for ejecting liquid nitrogen, and moreover, a running cost based on the use of liquid nitrogen must be taken into consideration.

Therefore, the present inventor has developed a cutting apparatus having a pair of cutting blades that are respectively provided to be capable of approaching/separating movement on both sides relative to the elongated-shaped highly-viscous substance being extrude and that are arranged with blade edge parts thereof facing each other while having the thickness directions of the paired cutting blades oriented in the elongation direction of the highly-viscous substance. This enables the pair of cutting blades to cut the elongated-shaped highly-viscous substance from both left and right sides through the approaching movement toward each other, and the elongated-shaped highly-viscous substance can be restrained from bending to one side at the time of cutting. As a result, neither a liquid nitrogen ejector structure nor liquid nitrogen used therewith is required for restraining the elongated-shaped highly-viscous substance from bending to one side, so that the configuration can be simplified.

PRIOR ART DOCUMENT

Patent Document

Patent Document 1: Japanese Laid-Open Patent Publication No. 4-232318

SUMMARY OF THE INVENTION

Problem to be Solved by the Invention

However, if an elongated-shaped highly-viscous substance is cut by a pair of cutting blades as described above, blade edge parts of the pair of cutting blades come into contact with each other and, therefore, a damage may occur in the blade edge parts, which are the weakest parts of the cutting blades.

The present invention was conceived in view of such a circumstance and it is therefore a first object of the present invention to provide a cutting apparatus not only capable of restraining a highly-viscous substance from bending by using a simple configuration at the time of cutting of the elongated-shaped highly-viscous substance but also capable of preventing a damage of a blade edge part as much as possible.

A second object is to provide a cutting blade used in the cutting apparatus.

Means for Solving Problem

To achieve the first object, the present invention has configurations of (1) to (10).

(1) In a cutting apparatus having a pair of cutting blades provided to be capable of approaching/separating movement, the cutting blades being arranged with blade edge parts thereof facing each other while having thickness directions thereof oriented in the same direction, the cutting blades each have a thickness gradually increased from a blade edge leading end toward a blade root part, the cutting blades each have the blade edge part offset from the blade edge part of the counterpart cutting blade in the thickness direction of the cutting blades within a range facing a thickness-direction surface of the counterpart cutting blade, and the cutting blades each have the thickness-direction surface made of a material having a hardness lower than that of the blade edge part of the counterpart cutting blade at least in a region faced by the blade edge part of the counterpart cutting blade.

According to this configuration the elongated-shaped highly-viscous substance can be cut from both left and right sides relative to the substance through the approaching movement of the pair of cutting blades, so that the highly-viscous substance can be restrained from bending at the time of cutting even without providing a liquid nitrogen ejecting mechanism etc.

On the other hand, the cutting blades each having a thickness gradually increased from a blade edge leading end toward a blade root part are used as a pair of cutting blades; the cutting blades each have the blade edge part offset from the blade edge part of the counterpart cutting blade in the thickness direction of the cutting blades within a range facing a thickness-direction surface of the counterpart cutting blade; the cutting blades each have the thickness-direction surface made of a material having a hardness lower than that of the blade edge part of the counterpart cutting blade at least in a region faced by the blade edge part of the counterpart cutting blade; therefore, a direct contact between the blade edge parts can be avoided at the time of cutting of the highly-viscous substance and, accordingly, even if the blade edge part comes into contact with the thickness-direction surface of the counterpart cutting blade, the weakest part, i.e., the blade edge part, of the cutting blade can be prevented from being damaged based on the fact that at least a region faced by the blade edge part of the counterpart cutting blade is made of a material having a hardness lower than that of the blade edge part of the counterpart cutting blade.

Therefore, the highly-viscous substance can be restrained from bending by using a simple configuration at the time of cutting of the elongated-shaped highly-viscous substance and, additionally, a damage of the blade edge parts can be prevented as much as possible.

(2) Under the configuration of (1), the blade edge parts of the cutting blades are made of a metal.

According to this configuration, since the blade edge parts of the cutting blades are made of a metal, the highly-viscous substance can precisely be cut, and in this case, even if the blade edge part made of a metal comes into contact with the thickness-direction surface of the counterpart cutting blade, the blade edge part can be prevented from being damaged based on the fact that at least a contact region thereof is made of a material having a hardness lower than that of the metal. Therefore, the same effects as (1) described above can specifically be acquired.

(3) Under the configuration of (2), the cutting blades each have the thickness-direction surface formed of a resin surface at least in a region faced by the blade edge part of the counterpart cutting blade.

According to this configuration, even if the blade edge part of the counterpart cutting blade made of a metal comes into contact with the thickness-direction surface of the cutting blade, the blade edge part of the counterpart cutting blade can be prevented from being damaged based on the resin surface in a contact region thereof.

(4) Under the configuration of (3), the cutting blades each have a surface formed of a resin surface except a blade edge surface.

According to this configuration, the highly-viscous substance can be prevented from adhering to the cutting blade in association with the cutting of the highly-viscous substance and, even if the cutting blade is continuously used, the highly-viscous substance can be restrained from being bent by the highly-viscous substance adhering to the cutting blade at the time of cutting of the highly-viscous substance.

(5) Under the configuration of (1), the cutting blades each have the thickness-direction surface with a shape extending from the blade edge leading end to the blade root part while maintaining a constant width, and the blade edge leading ends of the cutting blades are each inclined as one end of the thickness-direction surface with respect to the width direction of the cutting blades and are arranged in parallel with each other.

According to this configuration, at the time of cutting of the highly-viscous substance, a use position of the blade edge leading end of each of the cutting blades (a position of contact with the highly-viscous substance) is continuously changed in accordance with the approaching movement of the two cutting blades, so that the blade edge leading ends of the cutting blades can effectively be utilized in the range in the width direction. Therefore, as compared to those without the change in the use position of the blade edge leading ends of the cutting blades, a cutting load can be reduced so as to extend the usable period (period before replacement) of the cutting blades.

(6) In a cutting apparatus having a pair of cutting blades provided to be capable of approaching/separating movement, the cutting blades being arranged with blade edge parts thereof facing each other while having thickness directions thereof oriented in the same direction, the cutting blades each have a thickness gradually increased from a blade edge leading end toward a blade root part, the cutting blades each have the blade edge part offset from the blade edge part of the counterpart cutting blade in the thickness direction of the cutting blades within a range facing a thickness-direction surface of the counterpart cutting blade, and the cutting blades are each formed of a resin surface at least on a blade edge surface thereof and a region faced by the blade edge part of the counterpart cutting blade on the thickness-direction surface thereof.

According to this configuration, even though the blade edge surfaces of a pair of the cutting blade are resin surfaces, the highly-viscous substance can precisely be cut without bending and, since the thickness-direction surface of each of the cutting blades is formed of a resin surface in the region faced by the blade edge part of the counterpart cutting blade, the blade edge parts of the cutting blades can be prevented from being damaged.

Therefore, the cutting apparatus also can not only cut the highly-viscous substance while restraining the highly-viscous substance from bending by using a simple configuration, but also prevent a damage of the blade edge parts as much as possible at the time of cutting.

(7) Under the configuration of (6), the cutting blades each have the entire surface formed of a resin surface.

According to this configuration, the highly-viscous substance can be prevented from adhering to the cutting blade in association with the cutting of the highly-viscous substance by using the resin surface and, even if the cutting blade is continuously used, the highly-viscous substance can be restrained from being bent by the highly-viscous substance adhering to the cutting blade at the time of cutting of the highly-viscous substance.

(8) Under the configuration of (7), the cutting blades each include a core material having a rigidity higher than that of a resin constituting the resin surface, and the entire surface of the core material is coated with the resin.

According to this configuration, the highly-viscous substance can be prevented from adhering to the cutting blade at the time of cutting (the use of the cutting blade with the highly-viscous substance adhering thereto can be avoided) by using a coating resin, and the rigidity of the cutting blades can be ensured by the core material coated with the coating resin.

(9) Under the configuration of (6), the cutting blades each have a core material having the same shape as the cutting blades and a rigidity higher than that of a resin constituting the resin surface, and a resin tape is affixed to thickness-direction surfaces on both sides of the core material from a blade edge leading end to a blade root part of the core material.

According to this configuration, by using the resin tape and the core material, the cutting apparatus substantially producing the same effects as (8) described above can easily be acquired.

(10) Under the configuration of (6), the cutting blades each have the thickness-direction surface with a shape extending from the blade edge leading end to the blade root part while maintaining a constant width, and the blade edge leading ends of the cutting blades are each inclined as one end of the thickness-direction surface with respect to the width direction of the cutting blades and are arranged in parallel with each other.

According to this configuration, at the time of cutting of the highly-viscous substance, a use position of the blade edge leading end of each of the cutting blades (a position of contact with the highly-viscous substance) is continuously changed in accordance with the approaching movement of the two cutting blades, so that the blade edge leading ends of the cutting blades can effectively be utilized in the range in the width direction. Therefore, as compared to those without the change in the use position of the blade edge leading ends of the cutting blades, a cutting load can be reduced so as to extend the usable period (period before replacement) of the cutting blades.

To achieve the second object, the present invention has configurations of (11) to (19).

(11) In a cutting blade used as one of a pair of cutting blades having respective thickness-direction surfaces overlapping with each other from a blade edge leading end toward a blade root part when the cutting blades are allowed to perform an approaching movement toward each other with thickness directions thereof oriented to the same direction, the cutting blade has a thickness gradually increased from the blade edge leading end toward the blade root part, the cutting blade has the thickness-direction surface made of a material having a hardness lower than that of the blade edge part at least in a region to be contacted with a counterpart blade edge part.

According to this configuration, the cutting blade used in (1) described above can be provided.

(12) Under the configuration of (11), the blade edge part is made of a metal.

According to this configuration, since the blade edge part is made of a metal, the same effects as (11) described above can specifically be acquired.

(13) Under the configuration of (12), the thickness-direction surface is formed of a resin surface at least in a region to be contacted with the counterpart blade edge part.

According to this configuration, the cutting blade used in (3) described above can be provided.

(14) Under the configuration of (11), the thickness-direction surface has a shape extending from the blade edge leading end to the blade root part while maintaining a constant width, and the blade edge leading end is inclined as one end of the thickness-direction surface with respect to the width direction.

According to this configuration, the cutting blade used in (5) described above can be provided.

(15) In a cutting blade used as one of a pair of cutting blades having respective thickness-direction surfaces overlapping with each other from a blade edge leading end toward a blade root part when the cutting blades are allowed to perform an approaching movement toward each other with thickness directions thereof oriented to the same direction, the cutting blade has a thickness gradually increased from the blade edge leading end toward the blade root part, at least the thickness-direction surfaces on both sides are formed of resin surfaces from the blade edge leading end toward the blade root part.

According to this configuration, the cutting blade used in (6) described above can specifically be provided.

(16) Under the configuration of (15), the entire surface is formed of a resin surface.

According to this configuration, the cutting blade used in (7) described above can specifically be provided.

(17) Under the configuration of (16), the cutting blade includes a core material having a rigidity higher than that of a resin constituting the resin surface, and the entire surface of the core material is coated with the resin.

According to this configuration, the cutting blade used in (8) described above can specifically be provided.

(18) Under the configuration of (15), the cutting blades each have a core material having the same shape as the cutting blades and a rigidity higher than that of a resin constituting the resin surface, and a resin tape is affixed to thickness-direction surfaces on both sides of the core material from a blade edge leading end to a blade root part of the core material.

According to this configuration, the cutting blade used in (9) described above can specifically be provided.

(19) Under the configuration of (15), the thickness-direction surface has a shape extending from the blade edge leading end to the blade root part while maintaining a constant width, and the blade edge leading end is inclined as one end of the thickness-direction surface with respect to the width direction.

According to this configuration, the cutting blade used in (10) described above can specifically be provided.

Effect of the Invention

From the above, the present invention can provide the cutting apparatus not only capable of restraining a highly-viscous substance from bending by using a simple configuration at the time of cutting of the elongated-shaped highly-viscous substance but also capable of preventing a damage of the blade edge parts as much as possible.

The present invention can also provide the optimum cutting blade used in the cutting apparatus.

MODES FOR CARRYING OUT THE INVENTION

Embodiments of the present invention will now be described with reference to the drawings.

Figure 1:
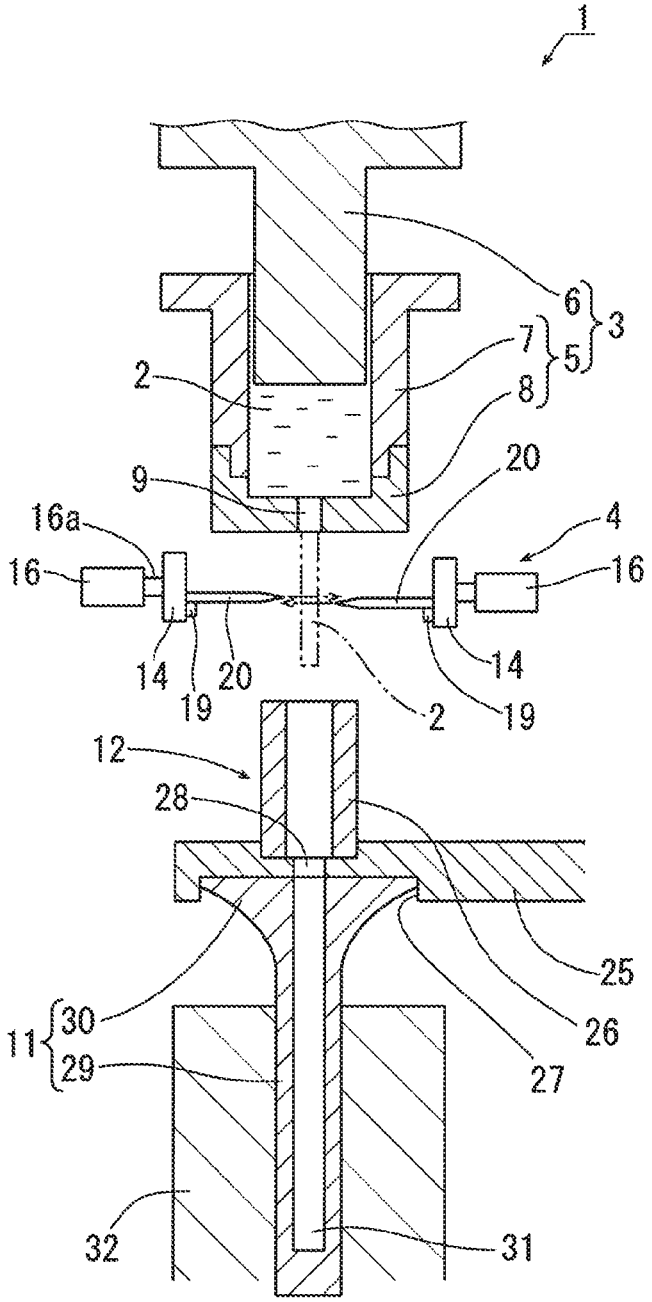
FIG. 1 is an explanatory view for explaining a state in which a cutting apparatus according to a first embodiment is disposed in a supplying apparatus supplying a highly-viscous substance.

In FIG. 1, reference numeral 1 denotes a supplying apparatus supplying a clay-like metallic sodium 2 as a highly-viscous substance into a hollow poppet valve intermediate 11 (an incorporating object). This supplying apparatus 1 includes an extruder 3 extruding the metallic sodium 2 into a rod shape, a cutting apparatus 4 according to an embodiment disposed on the lower side of the extruder 3 to cut the rod-like metallic sodium 2 extruded from the extruder 3, and a receiving mechanism 12 guiding the cut metallic sodium 2 into the hollow poppet valve intermediate 11.

As shown in FIG. 1, the extruder 3 includes an extruder main body 5 and a pressing tool 6.

The extruder main body 5 contains the metallic sodium 2, and the extruder main body 5 includes a cylindrical storage container 7 and a nozzle 8 provided on one end side of the storage container 7 to close an opening on the one end side. The cylindrical storage container 7 is attached to an attaching frame 10 (see FIG. 2; not shown in FIG. 1) with the axis thereof facing in the up-down direction, and the nozzle 8 is disposed on the lower side than the storage container 7 and has a squeezing hole 9 for linearly extruding the metallic sodium 2.

The pressing tool 6 has a lower end side slidably fitted into the storage container 7 as a pressing part. An upper end portion of the pressing tool 6 is coupled to a drive mechanism not shown, and the pressing tool 6 is pushed down by driving the drive mechanism. As a result, the metallic sodium 2 in the extruder main body 5 is linearly extruded through the nozzle 8 (the squeezing hole 9) to the outside (see an imaginary line of FIG. 1).

This extruded metallic sodium 2 is obviously adjusted by controlling the drive mechanism (the pressing tool 6). Specifically, the drive mechanism (the pressing tool 6) is stopped on condition that the length of the extruded metallic sodium 2 reaches a certain length from the leading end, and when the cutting by the cutting apparatus 4 described later is finished to achieve a state satisfying a start condition of freshly extruding the metallic sodium 2, the drive mechanism (the pressing tool 6) is driven again.

Figure 2:
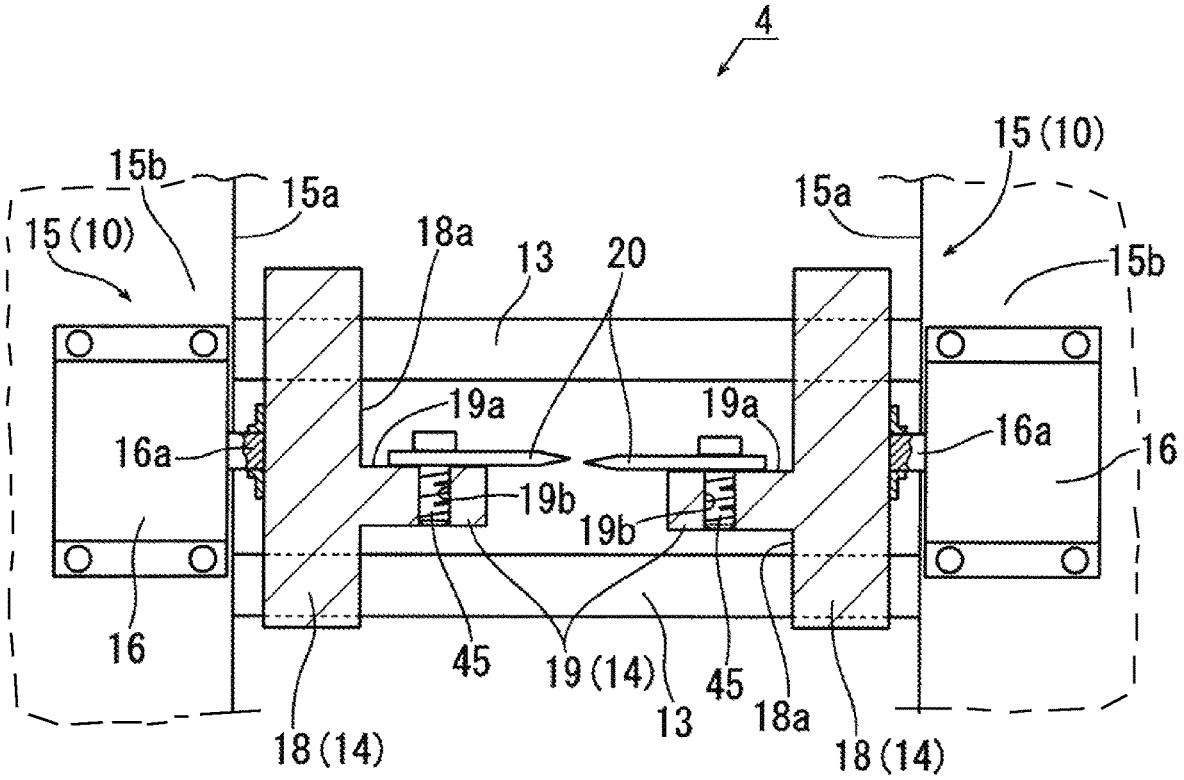
FIG. 2 is a partially cross-sectional front view of the cutting apparatus according to the first embodiment.

As shown in FIGS. 1 and 2, the cutting apparatus 4 includes a pair of guide bars 13, 13, a pair of holders 14, 14, a pair of cutting blades 20, 20, a pair of air cylinder devices (driving means) 16, 16.

The pair of the guide bars 13, 13 is attached to the mounting frame 10 in a vertically arranged state. As shown in FIG. 2, the mounting frame 10 includes a pair of prism-shaped support post parts 15, 15 extending in the vertical direction, and the paired support post parts 15, 15 are arranged on both left and right sides relative to an axis passing through the squeezing hole 9 of the nozzle 8 while facing each other. The paired guide bars 13 each extend between the paired support post parts 15, 15 in the parallel arrangement direction of the paired support columns 15 (the horizontal direction of FIG. 2) while maintaining a parallel relationship, and the end portions of the pair of the guide bars 13 are respectively connected to facing side surfaces 15*a* of the support post parts 15.

Each of the paired holders 14 includes a plate-like sliding part 18 held in a state of bridging between the paired guide bars 13, 13, and a holding part 19 provided integrally with the sliding part 18. Each of the sliding parts 18 is penetrated by the pair of the guide bars 13, 13, so that the sliding parts 18 can be guided by the pair of the guide bars 13, 13 to enable approaching/separating movement with respect to each other. The sliding parts 18 are projected forward from the pair of the guide bars 13, 13, and each of projected leading end portions of the sliding parts 18 is protruded forward from a front surface 15*b* of the support post part 15. The holding parts 19 are respectively provided on facing surfaces 18*a* of the sliding parts 18 facing each other. The holding parts 19 are each formed in a state of protruding toward the counterpart sliding part 18, and an upper surface 19*a* of each of the holding parts 19 is formed as a flat surface. An attachment hole 19*b* is opened in the upper surface 19*a* of the holding part 19, and a fastener 45 can be screwed into the attachment hole 19*b*.

Each of the paired cutting blades 20 is formed in a band plate shape. Each of the cutting blades 20 has a blade root part 21 side placed on the upper surface 19*a* of the holding part 19 such that the thickness direction thereof (the vertical direction of FIG. 2) faces upward and downward, and has a blade edge part 23 side protruded from the leading end of the holding part 19 toward the counterpart holding part 19. The cutting blades 20 are respectively attached to the holding parts 19 by utilizing the attachment holes 19*b* and the fasteners 45 under the state described above, and the blade edge parts 23 of the cutting blades 20 face each other on both left and right sides relative to the axis of the nozzle 8.

The paired air cylinder devices 16 are respectively attached to the front surface 15*b* of the support post parts 15 for the purpose of driving the holders 14 and the cutting blades 20. Extendible rods 16*a* of the air cylinder devices 16 are coupled to the holders (projected parts) 14, and the two holders 14 perform approaching/separating movement in accordance with the extending/retracting movement of the extensible rods 16*a* of the air cylinder devices 16. Accordingly, the two cutting blades 20, 20 perform the approaching/separating movement, and the extruded rod-like metallic sodium 2 is cut by the two cutting blades 20, 20.

Obviously, the air cylinder devices 16 each include an electromagnetic valve mechanism (air cylinder drive adjustment mechanism) adjusting supply and discharge of compressed air from a compressed air source not shown, and the control and adjustment thereof achieve the approaching/separating movement of the pair of the cutting blades 20, 20 described above. Specifically, on condition that the metallic sodium 2 extruded from the extruder 3 reaches a certain length and the pressing tool 6 (the drive mechanism) is stopped, the pair of the cutting blades 20, 20 separated until then is allowed to perform the approaching movement by controlling the solenoid valve mechanisms, and the pair of the cutting blades 20, 20 cuts the metallic sodium 2. After this cutting, the paired cutting blades 20, 20 are immediately separated (returned to standby positions).

As shown in FIG. 1, the receiving mechanism 12 is disposed under the extruder main body 5 on the lower side than the cutting apparatus 4. The receiving mechanism 12 includes a support plate 25 disposed on the lower side of the extruder main body 5 with plate surfaces facing upward and downward, a guide cylinder 26 disposed on the support plate 25 with an axial direction facing upward and downward, and a positioning recess 27 formed on a lower surface of the support plate 25.

The support plate 25 is provided with an introduction hole 28 faced by the squeezing hole 9 in the nozzle 8, and the introduction hole 28 penetrates between the upper and lower surfaces of the support plate 25. The guide cylinder 26 has an upper end opening facing the squeezing hole 9 in the nozzle 8 and a lower end opening facing the introduction hole 28. The positioning recess 27 is formed into a circular shape around the introduction hole 28 so that a head 30 of the poppet valve intermediate 11 serving as an incorporating object is fitted thereto, and the introduction hole 28 is opened in the positioning recess 27.

In the receiving mechanism 12, when the poppet valve intermediate 11 is filled (supplied) with the cut metallic sodium 2 described above, the head 30 of the poppet valve intermediate 11 is fitted in advance to the positioned recess 27 by utilizing a conveying apparatus 32. Obviously, as shown in FIG. 1, the poppet valve intermediate 11 has a stem 29 and the head (diameter expansion part) 30 provided with an expanded diameter at one end portion of the stem 29, and an internal space 31 extending from a leading end surface of the head 30 to the stem 29 is formed in the poppet valve intermediate 11 so as to fill the cut metallic sodium 2 as described above. When the head 30 of the poppet valve intermediate 11 is fitted into the positioning recess 27, the extrusion of the metallic sodium 2 by the extruder 3 and the cutting of the metallic sodium 2 by the cutting apparatus 4 are sequentially executed, and the cut metallic sodium 2 is guided though the through-hole of the guide cylinder 26 and the introduction hole 28 into the internal space 31 of the poppet valve intermediate 11.

Figure 3:
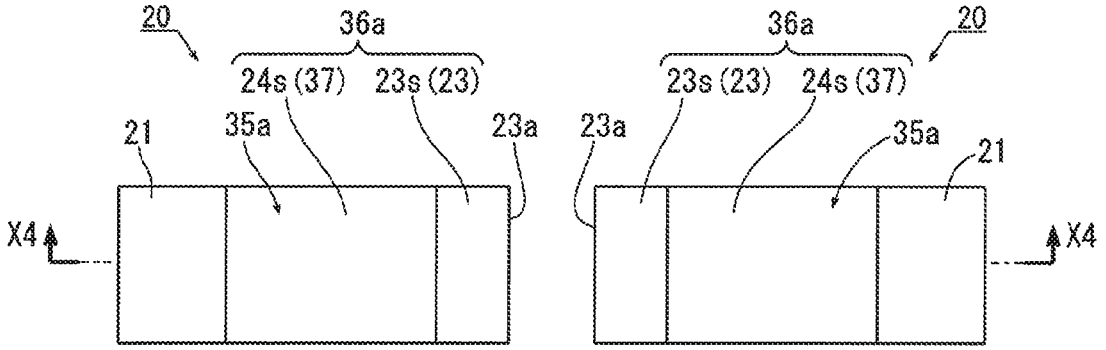
FIG. 3 is an enlarged plane view of an arrangement state of a pair of cutting blades according to the first embodiment.
Figure 4:
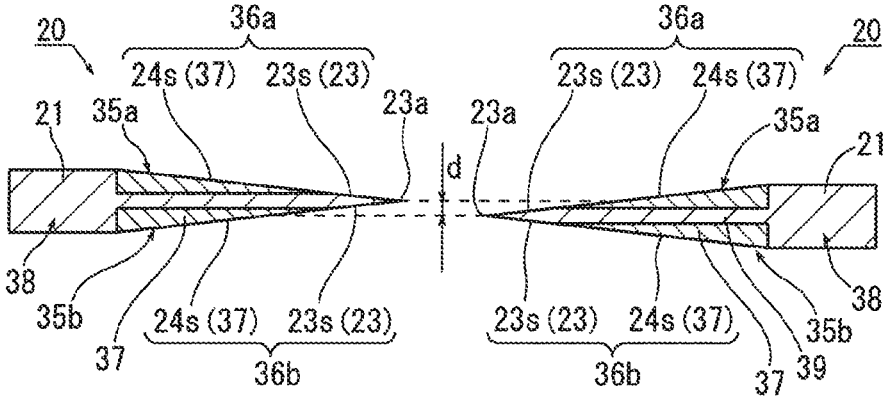
FIG. 4 is a cross-sectional view taken along a line X4-X4 of FIG. 3.
Figure 5:
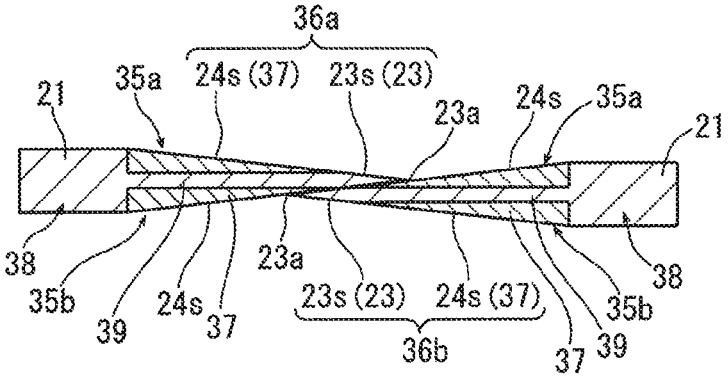
FIG. 5 is an operation state view for explaining an operation of the pair of cutting blades shown in FIG. 4.

The cutting apparatus 4 used in the supplying apparatus 1 as described above and the cutting blades 20 used in the cutting apparatus 4 are devised in consideration of durability, workability, etc. FIGS. 3 to 5 show the shape and structure of the cutting blades 20, the arrangement thereof in the cutting apparatus 4, etc., and in FIGS. 3 to 5, the holding part 19 holding the cutting blades 20 etc. are not shown.

The paired cutting blades 20 used in the cutting apparatus 4 each have a surface (hereinafter referred to as a thickness-direction surface) 35*a* (35*b*) facing in the thickness direction of the cutting blade 20 (vertical direction of FIG. 4) formed into a shape extending while maintaining a constant width based on the band plate shape. One wide end of the thickness-direction surface 35*a* (35*b*) is defined as a blade edge leading end 23*a*, and the other end portion is defined as the blade root part 21.

As shown in FIG. 4, the thickness of each of the cutting blades 20 is extremely thin at the blade edge leading end 23*a* and is gradually and evenly increased on both sides in the thickness direction from the blade edge leading end 23*a* toward the blade root part 21, and the thickness becomes constant after reaching the blade root part 21. Therefore, inclined surfaces 36*a* (36*b*) are respectively formed on the thickness direction side surfaces 35*a* (35*b*) in the range from the blade edge leading end 23*a* to the blade root part 21, and the two inclined surfaces 36*a*, 36*b* are separated from each other as a distance increases from the blade edge leading end 23*a* toward the blade root part 21.

As shown in FIG. 4, the inclined surfaces 36*a* (36*b*) are each made up of a surface 23*s*of the blade edge part 23 and a buffer surface 24*s*. The blade edge surface 23*s* exists over a comparatively short length from the blade edge leading end 23*a* before reaching the buffer surface 24*s*, and the buffer surface 24*s* extends from the end of the blade edge Dart 23 to the blade root Dart 21.

The cutting blades 20 are each formed by using a metal material 38 and a resin material 37 in consideration of the structure of the inclined surface 36*a* (36*b*). The metal material 38 integrally forms the entire blade edge part 23 including the blade edge surface 23*s*, the entire blade root part 21, and a coupling plate part 39 coupling the blade edge part 23 and the blade root part 21 with the maximum thickness of the blade edge part 23 and, in this embodiment, the blade edge surface 23*s* is made up of a metal surface. For this metal material 38, for example, any one of stainless steel, alloy tool steel, etc. is used in consideration of being used as the blade edge part 23.

The resin material 37 is integrated with each of thickness-direction surfaces 35*a*, 35*b* of the coupling plate part 39. The resin material 37 is provided such that a thickness increases toward the blade root part 21, and this resin material 37 forms a resin surface (hereinafter denoted by reference numeral 24*s* of the buffer surface) as the buffer surface 24*s* continuous to the blade edge surface 23*s*. The resin material 37 is preferably, for example, a material having a hardness considerably lower than the blade edge part 23 made of a metal and exhibiting high releasability for the metallic sodium 2 and, specifically, a thermoplastic resin etc. are preferable.

In this embodiment, the angle of the blade edge part 23 of each of the cutting blades 20 (the angle formed by the thickness-direction surfaces 35*a*, 35*b* on both sides) is set to a comparatively sharp angle, for example, 10° to 30°. This is because, when the angle of the blade edge part 23 is set to a sharp angle, the metallic sodium 2 is cut well although the blade edge part 23 is more easily damaged or chipped as compared to when the angle of the blade edge part 23 is set to an obtuse angle, and the braking and the chipping of the blade edge part 23 can be suppressed by the cutting blade 20 and the cutting apparatus 4 using the cutting blade 20 as described later.

As described above, the blade edge part 23 of each of the paired cutting blades 20 of the cutting apparatus 4 is vertically offset with respect to the blade edge part 23 of the counterpart cutting blade 20 as shown in FIG. 4. An offset amount d is set such that the blade edge part 23 of each of the cutting blades 20 faces the resin surface 24*s* of the inclined surface 36*a* (36*b*) of the counterpart cutting blade 20. Specifically, the offset amount is preferably set within a range of 0.05 mm to 0.2 mm with consideration given also to the cutting.

Therefore, when the paired cutting blades 20 are allowed to perform the approaching operation in the supplying apparatus 1, as shown in FIG. 5, the two blade edge parts 23, 23 are shifted to a state of vertically overlapping with each other although the leading ends 23*a* of the two blade edge parts 23 are not brought into contact with each other, and the metallic sodium 2 extruded from the extruder main body 5 is cut by the two blade edge parts 23, 23 crossing the metallic sodium 2. In this case, since the pair of the cutting blades 20 cuts the metallic sodium 2 from both left and right sides, the metallic sodium 2 is restrained from bending at the time of cutting even without providing a liquid nitrogen ejecting mechanism etc.

On the other hand, since the blade edge part 23 of each of the cutting blades 20 is offset with respect to the blade edge part 23 of the counterpart cutting blade 20 in the vertical direction within a range facing the resin surface 24*s* of the counterpart cutting blade 20, the contact between the blade edge leading ends 23*a* can be avoided at the time of cutting of the metallic sodium 2 and, additionally, even if the blade edge part 23 comes into contact with the thickness-direction surface 35*a* (35*b*) of the counterpart cutting blade 20 as shown in FIG. 5, the buffering action of the resin surfaces 24*s* is applied to the blade edge parts 23 based on the fact that a contact region (region to be contacted) thereof is the resin surface 24*s*, so that the weakest parts, i.e., the blade edge parts 23, of the cutting blades 20 can be prevented from being damaged.

In this embodiment, since the portion of the inclined surface 36*a* (36*b*) except the blade edge surface 23*s* is formed as the resin surface 24*s*, and a large portion involved in cutting is the resin surface 24*s* exhibiting the releasability for the metallic sodium 2, the metallic sodium 2 can be prevented from adhering to the cutting blade 20 in association with the cutting of the metallic sodium 2 and, even if the cutting blade 20 is continuously used, the metallic sodium 2 can be restrained from being bent by the metallic sodium 2 adhering to the cutting blade 20 at the time of cutting of the metallic sodium 2.

Figure 6:
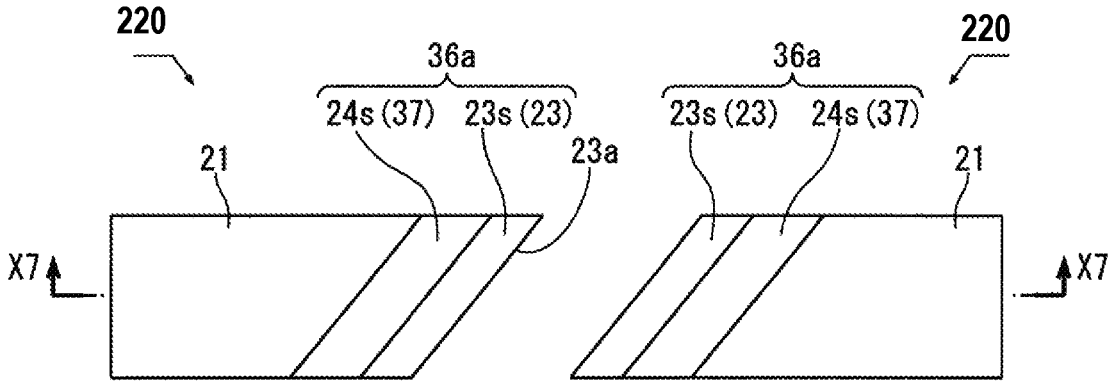
FIG. 6 is an enlarged plane view of an arrangement state of a pair of cutting blades according to a second embodiment.
Figure 7:
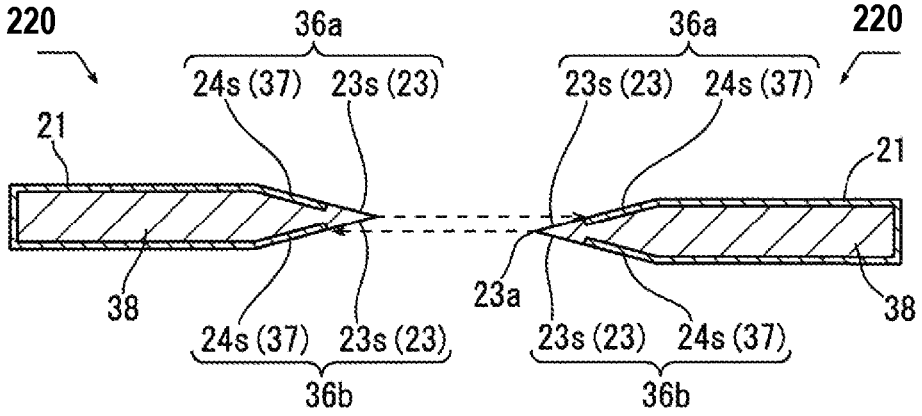
FIG. 7 is a cross-sectional view taken along a line X7-X7 of FIG. 6.
Figure 8:
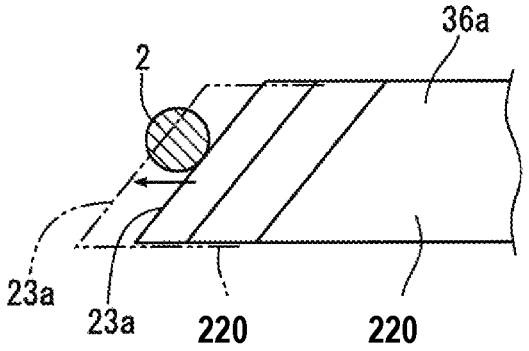
FIG. 8 is an explanatory view for explaining an operation of the cutting blades according to the second embodiment.
Figure 9:
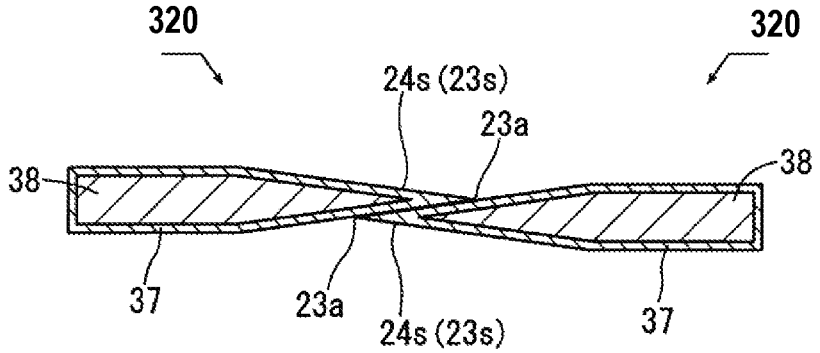
FIG. 9 is an enlarged vertical sectional view of a state of a pair of cutting blades according to a third embodiment at the time of cutting.
Figure 10:
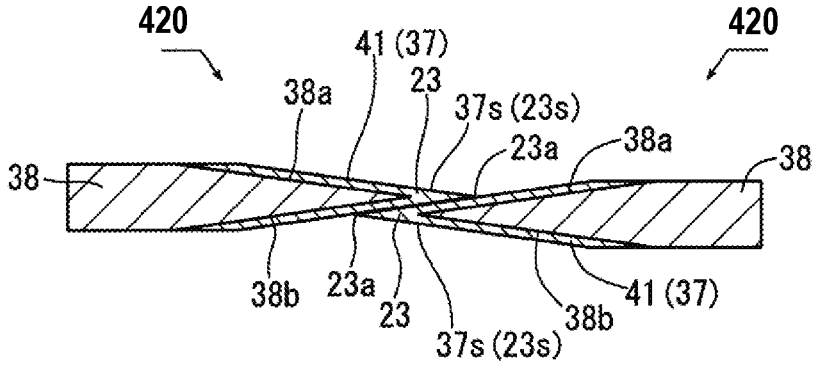
FIG. 10 is an enlarged vertical sectional view of a state of a pair of cutting blades according to a fourth embodiment at the time of cutting.
Figure 11:
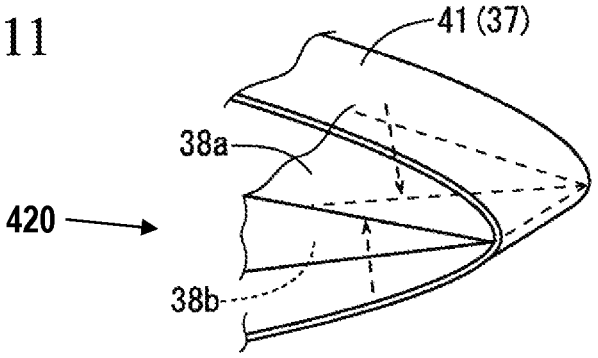
FIG. 11 is an explanatory view for explaining a structure of the cutting blade according to the fourth embodiment.
Figure 12:
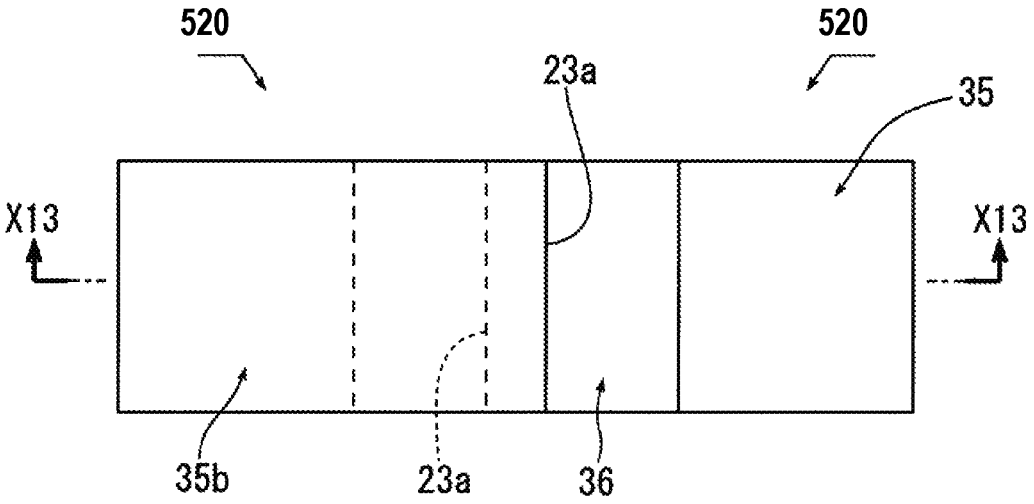
FIG. 12 is an enlarged plane view of an arrangement state on a pair of cutting blades according to a fifth embodiment.
Figure 13:
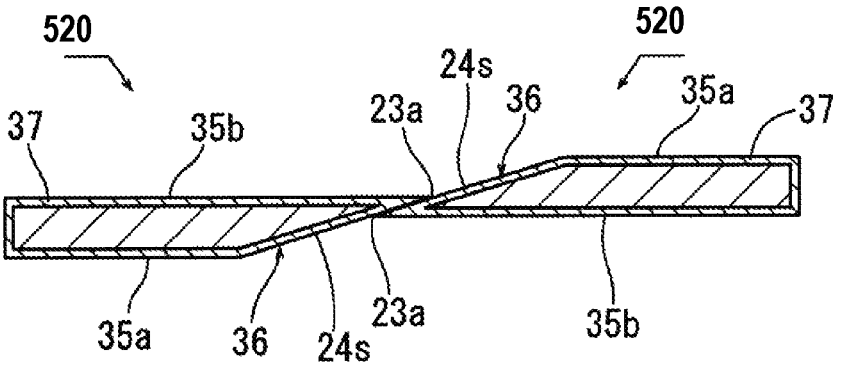
FIG. 13 is a cross-sectional view taken along a line X13-X13 of FIG. 12.

FIGS. 6 to 8 show a second embodiment 220, FIG. 9 shows a third embodiment 320, FIGS. 10 and 11 show a fourth embodiment 420, and FIGS. 12 and 13 show a fifth embodiment 520. In these embodiments, the same constituent elements as those of the first embodiment 20 are denoted by the same reference numerals and will not be described.

The second embodiment 220 shown in FIGS. 6 to 8 is a modification example of the first embodiment 20. In this second embodiment, the blade edge leading end 23*a* of each of the cutting blades 220 is inclined as one end of the thickness-direction surface 35*a* (35*b*) relative to the width direction of the cutting blade 220 (the vertical direction of FIG. 6), and the blade edge leading ends 23*a* of the two cutting blades 220, 220 are parallel to each other under the offset arrangement described above.

As a result, at the time of cutting of the metallic sodium 2, a use position of the blade edge leading end 23*a* of each of the cutting blades 220 (a position of contact with the metallic sodium 2) is continuously changed in accordance with the approaching movement of the two cutting blades 220, 220 as shown in FIG. 8 (see comparison between a solid line and an imaginary line of the blade edge leading end 23*a*), so that the blade edge leading ends 23*a* of the cutting blades 220 can effectively be utilized in the range in the width direction. Therefore, as compared to those without the change in the use position of the blade edge leading ends 23*a* of the cutting blades 220, a cutting load can be reduced so as to extend the usable period (period before replacement) of the cutting blades 220.

In this embodiment, the metal material 38 forms a shape close to the cutting blade shape, and the resin material 37 is applied as a film onto the surface of the metal material 38 except the blade edge surface 23*s* made of the metal material 38.

As a result, the resin surface 24*a* of the film (the resin material 37) can prevent the damage of the blade edge part 23 on the inclined surface 36*a* (36*b*) of the cutting blade 220 and, additionally, the metallic sodium 2 can further be restrained from adhering to the whole of the cutting blades 220 in association with the cutting of the metallic sodium 2, so that the use period of the cutting blades 220 can more preferably be extended.

It is noted that the film of the resin material 37 of FIG. 7 is exaggeratedly shown for clearly showing the presence (the same applies to FIGS. 9 to 11 and 13).

In the third embodiment 320 shown in FIG. 9, the metal material 38 forms a basic shape of the cutting blade (a shape with a thickness gradually and evenly increased on both sides facing in the thickness direction from one extremely thin end toward the other end side), and the resin material 37 is applied as a film onto the entire surface of the metal material 38 forming the basic shape of the cutting blade.

As a result, the entire surface of the cutting blade 320 is formed of the resin surface 24s, so that the metallic sodium 2 can further be restrained from adhering to the cutting blades 320, while preventing the damage of the blade edge part 23.

In this case, although the blade edge surface 23*s* is also made up of the resin surface 24*s*, the metal material 38 serves as a core material for the resin material 37, sufficient rigidity can be ensured for the cutting blade 320. Therefore, even when the cutting blades 320 are used in the cutting apparatus 2, the metallic sodium 2 can precisely be cut.

The fourth embodiment 420 shown in FIGS. 10 and 11 is a modification example of the third embodiment 320. In this fourth embodiment, a band-shaped resin tape 41 is used as the resin material 37, and the width of the resin tape 41 is the same as the width of a thickness-direction surface 38*a* (38*b*) of the metal material 38. As shown in FIG. 11, the resin tape 41 is bent to wrap around the metal material 38 from the leading end side of the metal material 38 forming the basic shape of the cutting blade, and the bent resin tape 41 is affixed to the thickness-direction surfaces 38*a*, 38*b* on both sides of the metal material 38.

As a result, cutting blades 420 substantially the same as those of the third embodiment 320 can be acquired.

In this embodiment, the resin tape 41 is present within a certain distance from the leading end of the metal material 38 toward the blade root part 21; however, obviously, the resin tape 41 maybe affixed to the entire thickness-direction surfaces 38*a*, 38*b* on both sides of the metal material 38.

The fifth embodiment 520 shown in FIGS. 12 and 13 is a modification example of the third embodiment 320. In this fifth embodiment, the inclined surface 36 is formed only on the surface on one side in the thickness direction of each of the cutting blades 520, and the surface on the other side in the thickness direction is a flat surface. When the cutting blades 520 are used in the cutting apparatus 4, the cutting blades 520 are shifted from each other in the thickness direction so that the blade edge leading end 23*a* of each of the cutting blades 520 faces the inclined surface 36 of the counterpart cutting blade 520.

Therefore, even if the blade edge leading end 23*a* of each of the cutting blades 520 comes into contact with the inclined surface 36 of the counterpart cutting blade 520 at the time of cutting of the metallic sodium 2, the entire surface including the inclined surface 36 is formed of the resin surface 24*s* (the coating surface of the resin material 37) and, therefore, the blade edge part 23 can be prevented from being damaged. Additionally, since the entire surface of each of the cutting blades 520 is formed of the resin surface 24s, the metallic sodium 2 can be restrained from adhering to the cutting blades 520 at the time of cutting of the metallic sodium 2 as is the case with the third embodiment 320, so that the use period of the cutting blades 520 can preferably be extended.

Although the embodiments have been described, the present invention include the following forms.

(1) Besides the resin material 37, a material other than the resin material 37 such as rubber is used as the material having a hardness lower than that of the blade edge part 23.

(2) In the first embodiment, coating with the resin material 37 is applied except the blade edge parts 23.

(3) The form of the blade edge parts 23 of the second embodiment is applied to forms (the third to fifth embodiments) in which the inclined surfaces 36 (36*a*, 36*b*) are entirely formed of the resin surfaces 24*s*.

(4) The cutting blades according to the third and fifth embodiments 320, 520 are entirely made only of the resin material 37.

EXPLANATIONS OF LETTERS OR NUMERALS

1 supplying apparatus
2 metallic sodium (highly-viscous substance)
4 cutting apparatus
20 cutting blade
21 blade root part
23 blade edge part
23*a* blade edge leading end
23*s* blade edge surface
24*s* buffer surface, resin surface
37 resin material
38 metal material (core material)
41 resin tape

The invention claimed is:

1. A cutting apparatus having first and second cutting blades configured to approach and separate from one another, the first and second cutting blades having first and second blade edge parts, respectively, being arranged to face each other while thickness directions of the first and second cutting blades are oriented in a same direction, each of the first and second cutting blades being fixed to first and second holders, respectively, so that the first blade edge part protrudes from a first tip of the first holder and the second blade edge part protrudes from a second tip of the second holder, the first and second holders approaching and separating from each other such that the first and second cutting blades approach, contact, and separate from each other, the first and second cutting blades each having a thickness increasing from a respective blade edge leading end toward a respective blade root part, the first and second cutting blades each having its respective blade edge part offset from the blade edge part of the other of the first and second cutting blades in the thickness directions of the cutting blades, each of the first and second cutting blades having a thickness-direction surface made of a material having a hardness lower than that of the blade edge part of the other of the first and second cutting blades, each of the thickness-direction surfaces contacting the blade edge part of the other of the first and second cutting blades when the cutting blades approach one another, wherein the blade root part of each of the first and second cutting blades extends across an entirety of the thickness of the respective blade, and the blade root part and a respective tip end of the blade edge part of each of the first and second cutting blades are formed from a continuous metal body, and the blade root part of each of the first and second cutting blades is formed only by the continuous metal body, wherein each of the first and second cutting blades is fixed to the first and second holders, respectively, at its respective blade root part, and wherein each of the tip ends of the first and second bade edge parts is tapered to an angle between 10° to 30°.

2. The cutting apparatus according to claim 1, wherein the first and second cutting blades each have a constant width from the blade edge leading end to the blade root part, and wherein the blade edge leading ends of the first and second cutting blades are each inclined at one end in the thickness-directions, and wherein the blade edge leading ends are arranged in parallel with each other.

3. The cutting apparatus according to claim 1, wherein each of the first and second cutting blades has its thickness-direction surface formed of a resin surface at least in a portion that faces the other of the first and second cutting blades in a direction that the first and second blades approach and separate from one another.

4. A cutting apparatus having a pair of cutting blades configured to approach and separate from one another, the cutting blades being arranged with blade edge parts of the cutting blades facing each other while having thickness directions of the cutting blades oriented in a same direction, each of the cutting blades being fixed to one of a pair of holders so that the blade edge parts protrude from respective tips of the holders, the pair of holders approaching and separating from each other such that the pair of cutting blades approach, contact, and separate from each other, each of the cutting blades having a blade edge and a blade root part, wherein a thickness of each of the cutting blades increases from a blade edge leading end of the respective cutting blade toward the blade root part of the respective cutting blade, the cutting blades each having the blade edge part offset from the blade edge part of the other of the pair of cutting blades in the thickness directions of the cutting blades, each cutting blade having a thickness-direction surface made of a material having a hardness lower than that of the blade edge part of the other of the pair of cutting blades, each of the thickness-direction surfaces contacting the blade edge part of the other of the pair of cutting blades when the pair of cutting blades approach one another, and wherein the blade root part of each of the cutting blades extends across an entirety of the thickness of the respective cutting blade, and the blade root part and a respective tip end of the bade edge part of each of the cutting blades are formed from a continuous metal body, and the blade root part of each of the cutting blades is formed only by the continuous metal body, wherein each cutting blade is fixed to its respective holder at its respective blade root part.

* * * * *